US008936096B2

(12) United States Patent
Marshall

(10) Patent No.: US 8,936,096 B2
(45) Date of Patent: Jan. 20, 2015

(54) RUBBER ELEMENT REMOVAL TOOL

(75) Inventor: Barry Marshall, Monahans, TX (US)

(73) Assignee: JTB Tools & Oilfield Services, LLC, Houston, TX (US)

( * ) Notice: Subject to any disclaimer, the term of this patent is extended or adjusted under 35 U.S.C. 154(b) by 380 days.

(21) Appl. No.: 13/456,437

(22) Filed: Apr. 26, 2012

(65) Prior Publication Data

US 2013/0284454 A1 Oct. 31, 2013

(51) Int. Cl.
*E21B 23/00* (2006.01)

(52) U.S. Cl.
USPC ..... 166/377; 166/84.3; 294/90

(58) Field of Classification Search
USPC ..... 166/377, 84.3, 379; 294/86.1, 86.2, 90
See application file for complete search history.

(56) References Cited

U.S. PATENT DOCUMENTS

| | | | | | |
|---|---|---|---|---|---|
| 1,967,517 | A * | 7/1934 | Rogers | 175/57 |
| 2,054,223 | A * | 9/1936 | Le Bus | 173/164 |
| 3,915,244 | A * | 10/1975 | Brown | 175/85 |
| 4,783,084 | A * | 11/1988 | Biffle | 277/323 |
| 4,949,796 | A * | 8/1990 | Williams | 175/209 |
| 5,116,095 | A | 5/1992 | Kotria | |
| 5,647,444 | A * | 7/1997 | Williams | 175/209 |
| 6,012,528 | A | 1/2000 | Van Winkle | |
| 6,412,554 | B1 * | 7/2002 | Allen et al. | 166/80.1 |
| 6,668,684 | B2 * | 12/2003 | Allen et al. | 81/57.15 |
| 7,699,109 | B2 | 4/2010 | May | |
| 2008/0105462 | A1 | 5/2008 | May | |
| 2013/0032359 | A1 * | 2/2013 | Riggs | 166/378 |
| 2013/0264838 | A1 * | 10/2013 | Havens et al. | 294/215 |

* cited by examiner

*Primary Examiner* — Robert E Fuller
(74) *Attorney, Agent, or Firm* — Egbert Law Offices, PLLC

(57) ABSTRACT

A method for removing a rubber element of a rotary control device includes closing an upper pulling ring around the rubber element, closing a lower stabilizing ring around a drill pipe stump, suspending the lower ring by a chain from the upper ring, connecting a hoist to the upper pulling ring, said lifting the drill stem until the chain tightens and the drill stem is pulled up through the rubber element so as to leave the rubber element free. The hoist is connected to a chain sling affixed to the upper pulling ring. The rubber element can then be released from the upper pulling ring.

7 Claims, 5 Drawing Sheets

RUBBER ELEMENT REMOVAL TOOL

CROSS REFERENCE TO RELATED APPLICATIONS

Not Applicable

STATEMENT REGARDING FEDERALLY SPONSORED RESEARCH OR DEVELOPMENT

Not Applicable

NAMES OF PARTIES TO JOINT RESEARCH AGREEMENT

Not Applicable

REFERENCE TO SEQUENCE LISTING

Not Applicable

DESCRIPTION OF ATTACHED APPENDIX

Not Applicable

BACKGROUND OF THE DISCLOSED TECHNOLOGY

1. Field of the Invention

The disclosed relates generally to the fields of oil and gas drilling rigs and down hole pressure control tools and, more specifically, to tools and methods for removing the rubber elements of a rotary control device for repair or replacement.

2. Description of Related Art

Most drilling rigs are required to utilize pressure control tools such as rotary control devices (RCDs) to help prevent down hole blowouts. Located on the inside of an RCD is a rubber element or seal. During drilling, wear and tear causes these rubber elements to wear out very quickly, requiring frequent replacement. The currently practiced methods to remove an RCD rubber element are archaic and dangerous. Heavy chains are attached and brute force is applied. As the rubber element releases (sometimes requiring up to 60,000 pounds of pressure to release a 250-4500 pound rubber element), it swings free on the chains with great force, causing the extremely heavy rubber element to reel around chaotically and dangerously.

Because the rubber elements in an RCD actually seal a tremendous amount of down hole pressure, they are subject to a great deal of abrasion and wear. Consequently, they must be replaced regularly.

There is therefore a need for a device and method to safely and more easily remove rubber elements of an RCD or related down hole tool for repair or replacement.

SUMMARY OF THE INVENTION

In accordance with the present disclosure, a device and method is disclosed for safely and more easily pulling a rubber element of an RCD from a drill stem.

An objective of the disclosure is a device and method to, in a controlled manner, pull an RCD rubber element from a drill stem.

An objective of the disclosure is a device and method to reduce the dangers associated with removing a rubber element of an RCD from a drill stem.

An objective of the disclosure is a device and method to shorten the time required to remove an RCD rubber element from a drill stem.

An objective of the disclosure is a device and method for removing seals or rubber elements from pressure control tools.

An objective of the disclosure is a tool for removing a rubber element of an RCD from a drill stem, the tool comprising an upper pulling ring of a circumference sufficient to traverse around the rubber element of an RCD, the ring having an open position and a closed position; a lower stabilizing ring of a circumference sufficient to traverse around a drill pipe stump, the ring having an open position and a closed position; a plurality of chains suspending the lower stabilizing ring vertically below the upper pulling ring, and a hoist connection above the top of the upper ring.

An objective for removing a rubber element of an RCD from a drill stem, the method comprising: opening an upper pulling ring and placing it around the rubber element; opening a lower stabilizing ring and placing it around a drill pipe stump, the lower ring being suspended vertically from the upper ring by a plurality of chains; holding the upper ring with a hoist; lifting the drill stem until the chains tighten and the drill stem is pulled up through the rubber element, leaving the rubber element free.

An objective for removing a rubber element of an RCD from a drill stem wherein both the upper pulling ring and the lower stabilizing ring comprise two jaws, each jaw having a fist end and a second end, wherein the first ends are fixedly hinged together and the second ends hold the jaws in a closed position by a removable pin.

Other advantages of the present invention will become apparent from the following descriptions, taken in connection with the accompanying figures, wherein, by way of illustration and example, an embodiment of the present invention is disclosed.

BRIEF DESCRIPTION OF THE DRAWINGS

The figures constitute a part of this specification and include exemplary embodiments to the invention, which may be embodied in various forms. It is to be understood that in some instances various aspects of the invention may be shown exaggerated or enlarged to facilitate an understanding of the invention. To enable more thorough understanding of the features and advantages of the present invention, reference is now made to the detailed description of the invention along with the accompanying figures in which.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The disclosed is a device and method for safely and more easily removing the rubber element of an RCD from the drill stem. Because the disclosed method and device incorporates both stabilizing and bracing features, it utilizes principles of leverage. As a result, the rubber element is pulled far more quickly and with far more control than when using traditionally known methods. The controlled pull and release makes the entire process far safer to employ.

Figure 1:
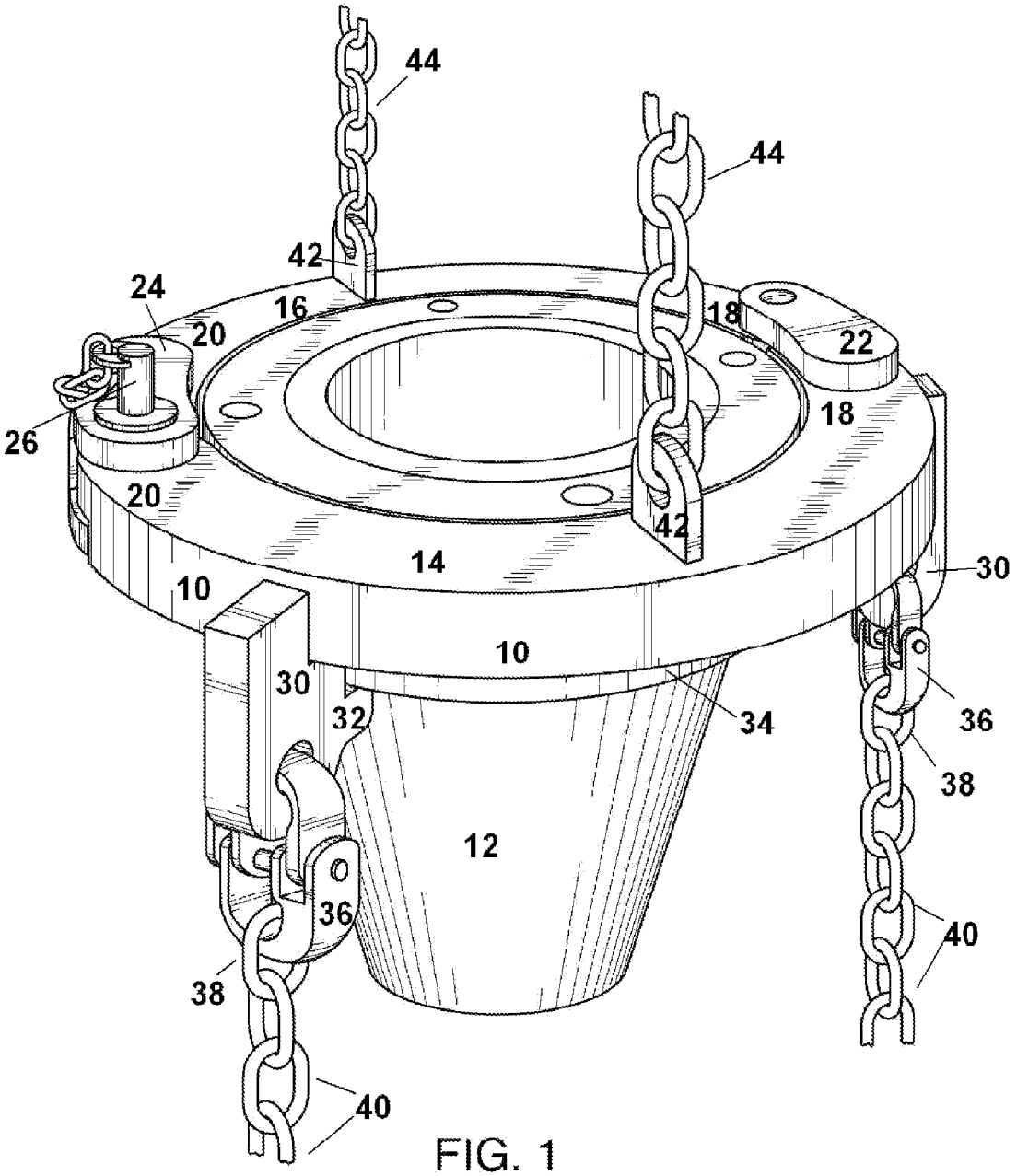
FIG. 1 depicts the upper ring (closed position) of a removal tool in accordance with a preferred embodiment of the disclosed device and method.

Turning to the figures for illustrative purposes, FIG. 1 depicts an upper pulling ring 10 of the disclosed RCD rubber element removal tool in a closed position, secured around the rubber element 12. This view discloses that the ring 10 is comprised of a first jaw 14 and a second jaw 16, each jaw having a first end 18 and a second end 20. The first ends of each jaw are fixedly hinged to each other by a hinge 22 capable of allowing a limited range of motion to enable the jaws to open and close. It is preferable to keep grease on the hinges to improve functionality. The second end 20 of the first jaw 14 culminates in a female end of a connection piece 24. The second end 20 of the second jaw 16 culminates in a male end of the connection piece 24. Both second ends have a through hole. When the two ends are connected, the through holes, not seen here, line up vertically and a removable primary pin 26 may be inserted all the way through all of the through holes to hold the jaws of the ring in a closed position. When the pin 26 is removed, the second ends 20 of the jaws of the ring are pulled open, causing the ring to assume its open position.

The primary pin 26 is, in a preferred embodiment, steel, although other similarly rigid, strong and durable materials could be used provided they met the objectives described herein.

Viewable in FIG. 1 are the holding feet 30 of the upper ring 10. The holding feet are not required for all models. Due to the fact that RCDs vary in their construction, the holding feet are of great use when removing the rubber element on certain models of RCDs and not necessary in removal of other models. In a preferred embodiment, the holding feet 30 have a beveled edge retaining lip 32 that hooks under the flange ring 34 of the rubber element 12. Affixed to a bottom edge of each of the holding feet 30 is a chain clevis 36 holding the first loop 38 of a chain 40 which vertically descends to a lower stabilizing ring.

FIG. 1 discloses two eye brackets 42 each having an eye through which traverses each end of a chain sling 44 which ascends vertically, enabling a rig operator to hold the tool and the rubber element using a hoist or other lifting or holding means. The chain sling 44 is used herein as the hoist connector, although other means of connecting a hoist to the tool could be appropriate, including but not limited to beams, tongs, hoist rings and chain hoists.

Figure 2:
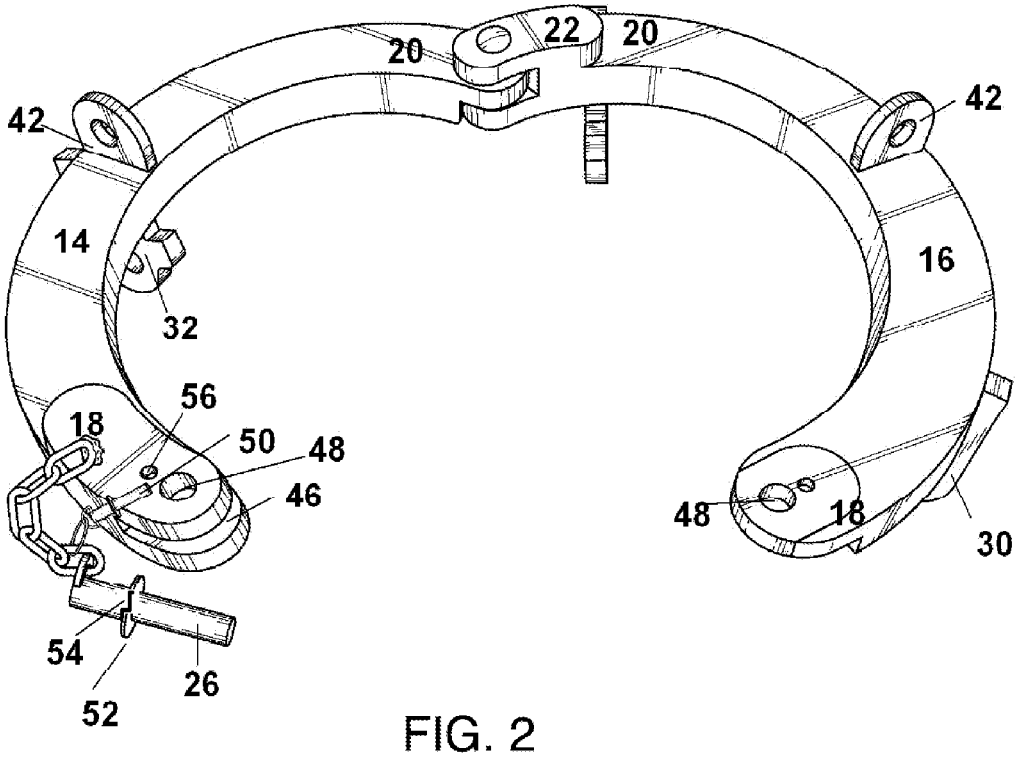
FIG. 2 depicts the upper ring (open position) of a removal tool in accordance with a preferred embodiment of the disclosed device and method.

FIG. 2 discloses a view of the upper pulling ring 10 in its open position, showing in more detail the open and close functionality of the upper ring 10, which is what enables it to open around the rubber element 12 and then close tightly on the rubber element 12. The first end 18 or female end, of the first jaw 14 has an inner groove 46 into which inserts the first end 18 of the second jaw 16, or male end. Both ends have a through hole 48 that lines up when first end 18 of the second jaw 16 is inserted into the inner groove 46 of the first end 18 of the first jaw 14. A primary pin 26 is inserted vertically all the way through all the through holes 48, holding the two ends together such that the jaws are closed and the entire upper ring is in a closed position. Although not shown in this view, the lower stabilizing ring is of the same components and construction as the upper pulling ring, although it is of substantially smaller circumference and lacks the holding feet 22. Once the pin 26 is removed, the two first ends of the jaws are pulled apart and the opposing hinge 22 of the second ends swivels, enabling the ring to be in its open position.

A safety pin 50 is also shown which may be used in conjunction with the primary pin 26. The primary pin 26 has a flat stop washer 52 that further has, on one side, a rounded notch 54. The safety pin 50 traverses through this notch 54 and continues downward through a secondary hole 56 that is adjacent to the through hole 48. The safety pin has a push-button top, which, when depressed, retracts a small ball on each side of the lower portion of the safety pin, causing it to be able to be removed from the secondary hole 56. When the pin 50 is inserted into the secondary hole 56 and the push-button top is released, the small on each side of the lower portion of the safety pin protrude, locking the safety pin 50 in place and, concurrently, holding the primary pin 26 in place as well.

Figure 3:
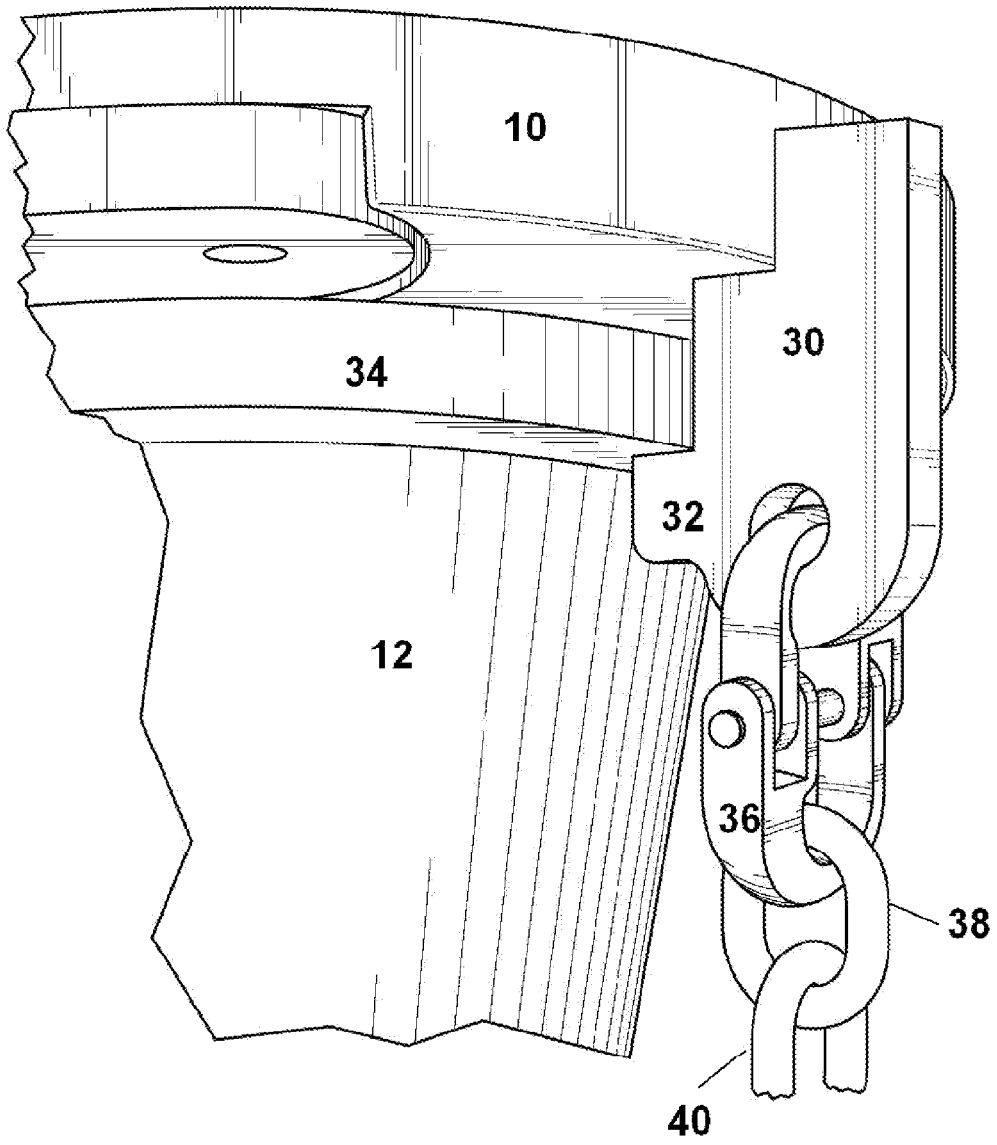
FIG. 3 depicts the holding feet of the upper ring in accordance with a preferred embodiment of the disclosed device and method.

FIG. 3 discloses, in more detail, one of the holding feet 30 of the upper ring 10 showing how the beveled edge retaining lip 32 hooks at the flange ring 34 of the rubber element 12 and further showing the clevis 36 and the chain 40 vertically descending.

Figure 4:
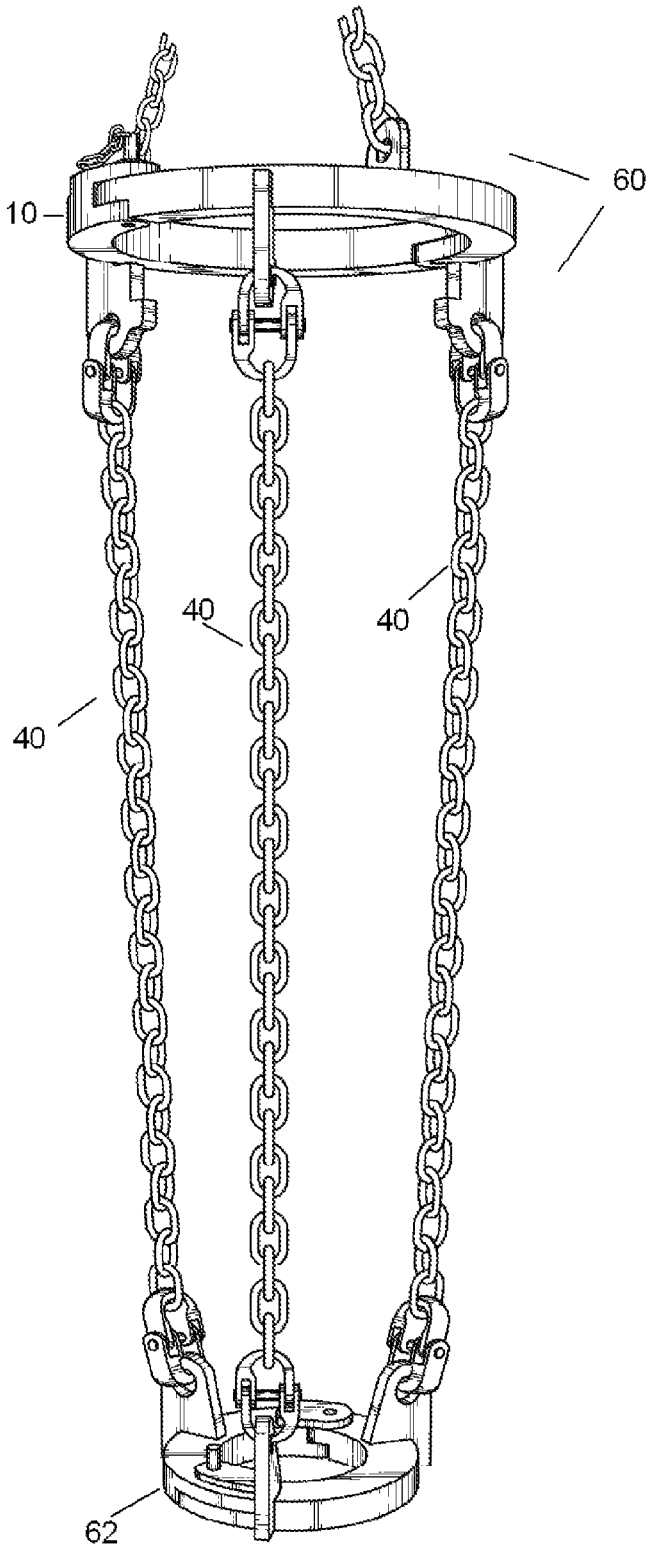
FIG. 4 depicts the removal tool device in accordance with a preferred embodiment of the disclosed device and method.

FIG. 4 reveals the entire RCD rubber element removal tool 60, revealing how the upper pulling ring 10 and lower stabilizing ring 62 are connected by a plurality of vertical chains 40, the chains suspending the lower ring from the upper ring. Also shown is the chain sling 44 ascending vertically above the upper pulling ring.

Figure 5:
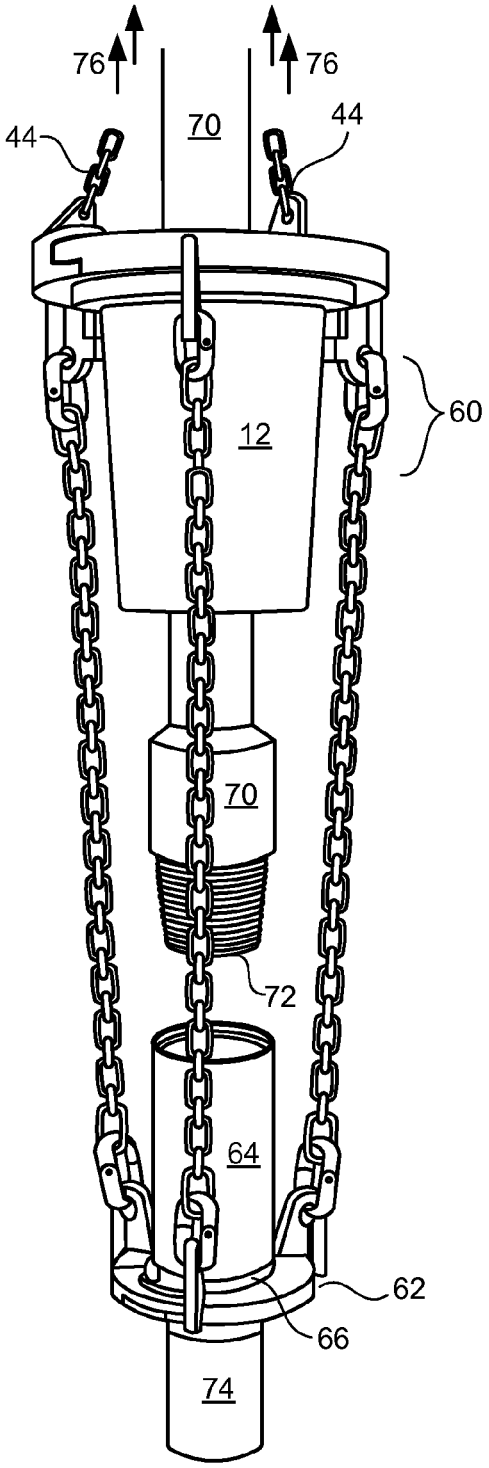
FIG. 5 depicts the removal tool device in accordance with a preferred embodiment of the disclosed device and method.

FIG. 5 reveals the same view as FIG. 4 however with the tool 60 in place on the drill stem 70. The upper ring 10 is shown closed tightly around the rubber element 12 and the lower ring 62 is closed tightly around the drill pipe stump 64. The lower ring 62 attaches to the drill pipe stump 64 under the upset and drill collar 66. The circumference of the upper ring can be changed to fit any size rotary control device "rubber element" and the lower ring size can be changed to fit any size drill pipe. The chain sling 44 allows the rig operator to lift, control, and move and position the tool 60 using a hoist or other similar means. Pictured in FIG. 5 is the drill stem 70 which is ultimately pulled vertically up through the rubber element 12 as shown by the directional arrows 76. The threaded end 72 of the drill stem 70 is shown disconnected from the drill pipe 74. The drill pipe travels vertically downward into the ground and is extremely heavy. The lower ring 62 being affixed around the drill pipe stump 64, therefore creates a great deal of stability and leverage for the tool 60.

In operation, the tool is used in the following manner to remove seals or rubber elements from pressure control tools such as RCDs. The upper ring 10 opens by removing the primary pin 26 and, if necessary, the safety pin 50, allowing the jaws to open, as the hinge 22 opposite the primary pin 26 allows the jaws to swivel. Once open, the upper ring 10 can be placed around the rubber element 12. Although in the illustrations, the upper ring is shown around the top of the rubber element, in some RCD models, the ring may be more appropriately placed around a different aspect of the rubber element, such as the middle. As the upper ring 10 is lowered onto the rubber element 12, the beveled edge 32 of the holding feet 30 hit the flange ring 34 located on the outside circumference of the rubber element 12. This allows the upper ring 10 to open slightly and then close once the flange ring 34 is inside the beveled edge 32. Once the ring 10 is closed, the primary 26 and the safety pins 50 are both inserted through the through holes 48. The holding feet 30 serve as a holding device once the rubber element 12 is removed. The feet 30 hold the rubber element 12 against the underside of the upper ring 10. This allows the rig operator to control and lower the rubber element 12 after it is freed from the drill stem 70.

The lower ring 62 opens by removing a primary pin 26 and the safety pin 50 (if applicable) and pulling the jaws apart, in the same fashion as the way the upper ring opens. Again, the jaws are able to open due to the hinge that is opposite from the pins. Once open, the lower ring is placed around the drill stem and the hinged jaws are closed and the primary pin and safety pin are inserted through the through holes. The lower ring does not have holding feet.

Once both upper 10 and lower rings 62 are closed and the pins are inserted the rig operator can begin to lift the drill stem 70 and rubber element 12. As the drill stem 70 and rubber element 12 are lifted, the upper side of the lower ring 62 hangs on the upset of the drill pipe stump 64 causing the lower ring 62 to remain stationary. The plurality of chains 40 suspending the lower ring 62 vertically from the upper ring 10 begin to tighten. At this point the rig operator tightens the chain sling 44 that is above the upper pulling ring 10. Once all the chains are tight, the chain sling 44 being held by the hoist, the rig operator then begins lifting the drill stem 70. As the rig operator continues to pull upward, the drill stem 70 begins to slide up through the now stationary rubber element 12. The tool 60 and the rubber element 12 remain stationary because the lower ring 62 is closed on the drill pipe stump 64. The rubber element 12 begins to slip off the bottom of the drill stem 70, as the drill stem 70 is lifted upward through the rubber element 12. When the drill stem 70 is released, the weight of the tool 60 and the rubber element 12 are left hanging free of the drill stem 70 by the hoist or other lifting device.

Once the rubber element is released, the tool and the rubber element are lowered by releasing tension on the plurality of chains vertically suspending the lower stabilizing ring from the upper pulling ring. The lower ring is then opened by removing the primary pin and safety pin and pulling apart the jaws which swivel open on the hinge that is opposite of the pins. The tool is lowered to the ground and the upper pulling ring is opened by removing the primary pin and the safety pin and pulling apart the jaws which swivel open on the hinge that is opposite of the pins. The rubber element is then released from the upper pulling ring.

Although holding feet are described herein with regard to the design, other bracing means may be appropriate for use with other brands and types of RCDs. In the preferred embodiment, the general structure of the tool will remain consistent, however, specially designed custom jigs may be affixed onto the upper pulling ring for use with specific RCD models, depending on the shape and structure of the RCD, provided the same objectives are met as described herein, namely that the upper pulling ring stays securely affixed to the rubber element.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

It is to be understood that the embodiments disclosed herein are shown for illustrative purposes and are not intended to be construed as limitations of the disclosed method and system. Those skilled in the art will recognize or be able to ascertain in the course of routine experimentation, that variations and equivalents of the embodiments may be undertaken without departing from the scope of the invention.

Certain terms are used throughout the description to refer to particular method components. As one skilled in the art will appreciate, design and manufacturing companies may refer to a component by different names. This document does not intend to distinguish between components that differ in name but not function.

The terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other intermediate devices and connections. Moreover, the term "method" means "one or more components" combined together. Thus, a method can comprise an "entire method" or "sub methods" within the method.

The use of the word "a" or "an" when used in conjunction with the word "comprising" may mean "one", or may also mean "one or more." The use of the term "or" in the claims is used to mean "and/or" unless explicitly indicated to refer to alternatives only or the alternatives are mutually exclusive, although the disclosures supports a definition that refers to only alternatives and "and/or."

The methods and systems disclosed and claimed herein can be made and executed without undue experimentation based on the level of disclosure presented. While the methods and systems have been described in terms of their preferred embodiments, it will be apparent to those skilled in the art that they are not limited to the exact steps described and may vary from such description without departing from the scope and spirit of the invention. The substitutes and modifications employed by one skilled in the art are deemed to fall within the scope of the invention.

What is claimed is:

1. A tool for removing a rubber element of a rotary control device from a drill stem, the tool comprising:
   - opening an upper pulling ring and closing said upper pulling ring around the rubber element;
   - opening a lower stabilizing ring and closing said lower stabilizing ring around the drill pipe stump, the lower stabilizing ring being suspended vertically from the upper pulling ring by a plurality of chains;
   - connecting a hoist to a hoist connection connected to the upper pulling ring;
   - lifting the drill stem until the plurality of chains tighten and the drill stem is pulled up through the rubber element, leaving the rubber element free.

2. The method of claim 1, wherein the upper pulling ring comprises two jaws, each jaw having a first end and a second end, wherein the first ends are fixedly hinged together and the second ends hold the jaws in a closed position by a removable primary pin.

3. The method of claim 1, wherein the lower stabilizing ring comprises two jaws, each jaw having a first end and a second end, wherein the first ends are fixedly hinged together and the second ends hold the jaws in a closed position by a removable primary pin.

4. The method of claim 1, wherein the hoist connection is a chain sling.

5. The method of claim 1, wherein the upper pulling ring further comprises at least two holding feet that brace the upper pulling ring against the rubber element.

6. The method of claim 5, wherein the holding feet further comprise a retaining lip that supports the holding feet rigidly under the rubber element.

7. The method of claim 1, further comprising a jig affixed to the upper pulling ring.

* * * * *